US008694307B2

(12) United States Patent
Shammass et al.

(10) Patent No.: US 8,694,307 B2
(45) Date of Patent: Apr. 8, 2014

(54) METHOD AND APPARATUS FOR TEMPORAL SPEECH SCORING

(75) Inventors: Sherrie Shammass, Gedera (IL); Moshe Wasserblat, Maccabim (IL); Oren Lewkowicz, Shoham (IL); Liron Aichel, Tel Aviv (IL); Oded Kalchiem, Rehovot (IL); Ishay Levi, Rishon Letzion (IL); Ronit Ephrat, Tel Aviv (IL); Adee Lavi, Kochav Yair (IL); Lior Hadaya, Ra'anana (IL)

(73) Assignee: Nice Systems Ltd., Ra'anana (IL)

( * ) Notice: Subject to any disclaimer, the term of this patent is extended or adjusted under 35 U.S.C. 154(b) by 445 days.

(21) Appl. No.: 13/110,940

(22) Filed: May 19, 2011

(65) Prior Publication Data

US 2012/0296642 A1 Nov. 22, 2012

(51) Int. Cl.
*G10L 21/00* (2013.01)

(52) U.S. Cl.
USPC ..... 704/211; 704/270

(58) Field of Classification Search
USPC ..... 704/211–218, 270, 275; 379/70, 379/265.01–265.14
See application file for complete search history.

(56) References Cited

U.S. PATENT DOCUMENTS

| | | | | |
|---|---|---|---|---|
| 6,275,806 | B1 * | 8/2001 | Pertrushin | 704/272 |
| 6,480,825 | B1 * | 11/2002 | Sharma et al. | 704/270 |
| 2002/0010587 | A1 * | 1/2002 | Pertrushin | 704/275 |

* cited by examiner

*Primary Examiner* — Abul Azad
(74) *Attorney, Agent, or Firm* — Soroker-Agmon

(57) ABSTRACT

A method and apparatus for speech analysis, comprising detecting an at least one temporal characteristic of an at least one speech of an at least one speaker, and deducing an at least one quantitative score from the at least one temporal characteristic, where the at least one quantitative score indicates an at least one extent of an at least one behavioral aspect of the at least one speaker.

21 Claims, 10 Drawing Sheets

METHOD AND APPARATUS FOR TEMPORAL SPEECH SCORING

BACKGROUND

The present disclosure generally relates to speech analysis, and more specifically to temporal analysis of speech.

Non-linguistic vocalizations such as tone of voice or temporal variation in a speech may indicate a mood or temperament or overall feeling of a talking person. Additionally, temporal attributes in a conversation such as talk-over or rate of speech may indicate how the participants relate to each other or the spirit of the interaction between the participants.

Some exemplary publications relating to non-linguistic expressions are cited below.

For example, Pentland, Alex, Social Dynamics: Signals and Behavior, MIT Media Laboratory Technical Note 579 (ICDL'04, San Diego, October 20-22, http://www.scribd.com/doc/48922344/Social-Dynamics-Signals-and-Behavior) reports automated measures of non-linguistic signaling, and states that they can be used to form predictors of objective and subjective outcomes in several situations.

Another example is, Gatica-Perez, Daniel, Modeling interest in face-to-face conversations from multimodal nonverbal behavior, Jun. 15, 2009 (http://www.idiap.ch/~gatica/publications/Gatica-book-mmsp09.pdf) reports a concise review of representative work related to interest modeling in face-to-face conversations from multimodal nonverbal behavior.

Yet another example is Doucet, Lorna Marie, Responsiveness: Emotion and Information Dynamics in Service Interactions (April 1998), Wharton Financial Institutions Center Working Paper No. 98-15. (http://ssrn.com/abstract=145306 or doi:10.2139/ssrn.145306) reports a cross-sectional study of 250 service interactions, and provides evidence regarding individual and environmental differences in emotional and informational responsiveness in service interactions.

SUMMARY

One exemplary embodiment of the disclosed subject matter is a method for speech analysis, comprising detecting an at least one temporal characteristic of an at least one speech of an at least one speaker, and deducing an at least one quantitative score from the at least one temporal characteristic. Optionally, the at least one quantitative score indicates an at least one extent of an at least one behavioral aspect of the at least one speaker.

Another exemplary embodiment of the disclosed subject matter is a method for managing a verbal interaction, comprising detecting an at least one temporal characteristic of an at least one speech of an at least one speaker of a plurality of speakers in a verbal interaction, deducing an at least one quantitative score from the at least one temporal characteristic, and intervening in the verbal interaction according to the at least one quantitative score.

Yet another exemplary embodiment of the disclosed subject matter is a system for speech analysis, comprising an at least one computerized apparatus operable to analyze temporal characteristics of a captured voice to obtain a quantitative score respective to a correlation between the temporal characteristics and a provided reference pattern.

For brevity and clarity and without limiting and unless otherwise specified, in the present disclosure the speech of one or more persons is denoted as a verbal interaction, and a person is denoted as a speaker. For example, a conversation between two persons is referred to as a verbal interaction of two speakers.

In the context of the present disclosure, without limiting, a behavioral aspect implies features or expression of a behavior of a speaker and/or behavior of two or more speakers in a verbal interaction such as a conversation.

BRIEF DESCRIPTION OF THE DRAWINGS

Some non-limiting exemplary embodiments or features of the disclosed subject matter are illustrated in the following drawings.

Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described.

Figure 1A:
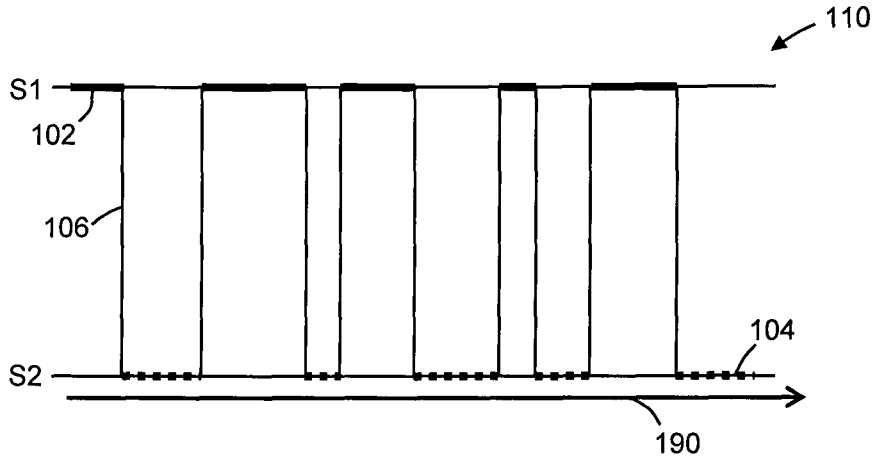

Dimensions of components and features shown in the figures are chosen for convenience or clarity of presentation and are not necessarily shown to scale or true perspective. For convenience or clarity, some elements or structures are not shown or shown only partially and/or with different perspective or from different point of views.

References to previously presented elements are implied without necessarily further citing the drawing or description in which they appear.

Figure 1B:
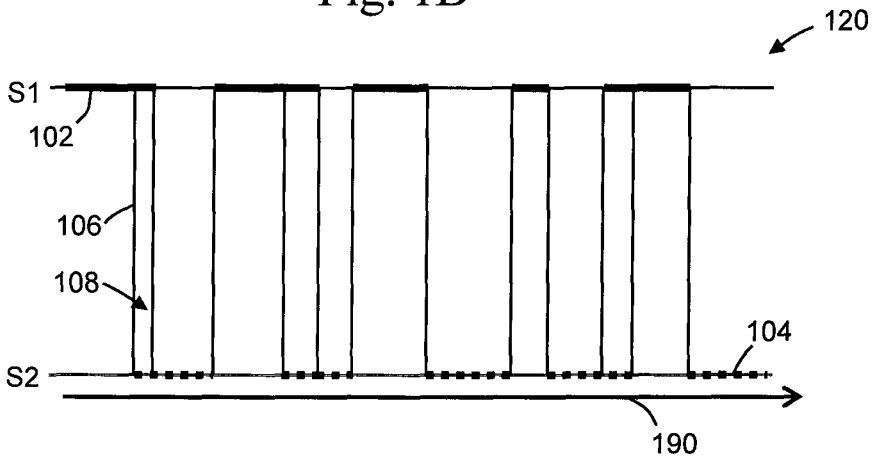
Figure 1C:
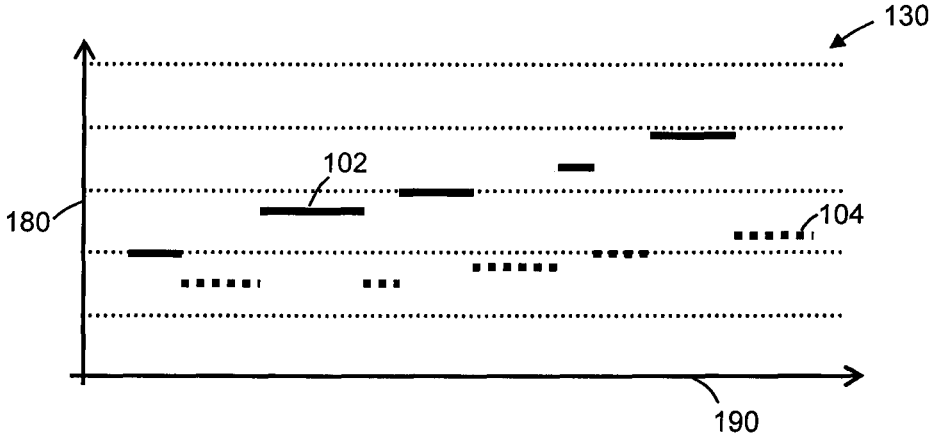
Figure 2:
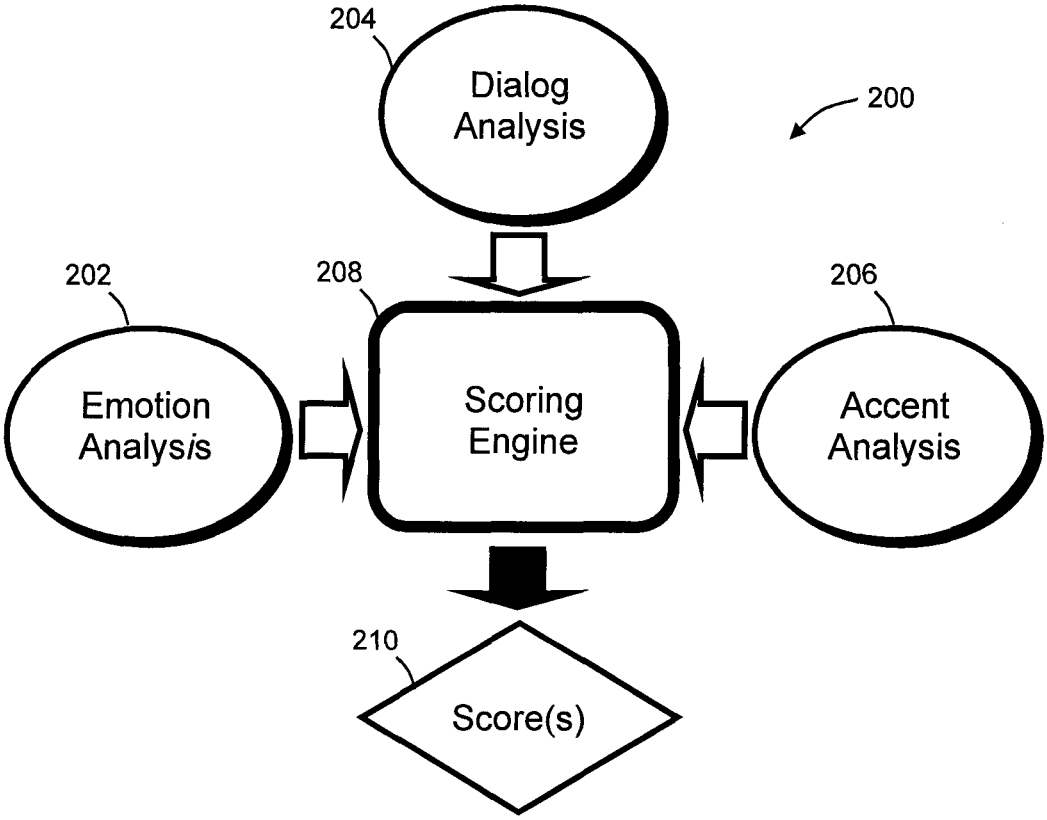
Figure 3:
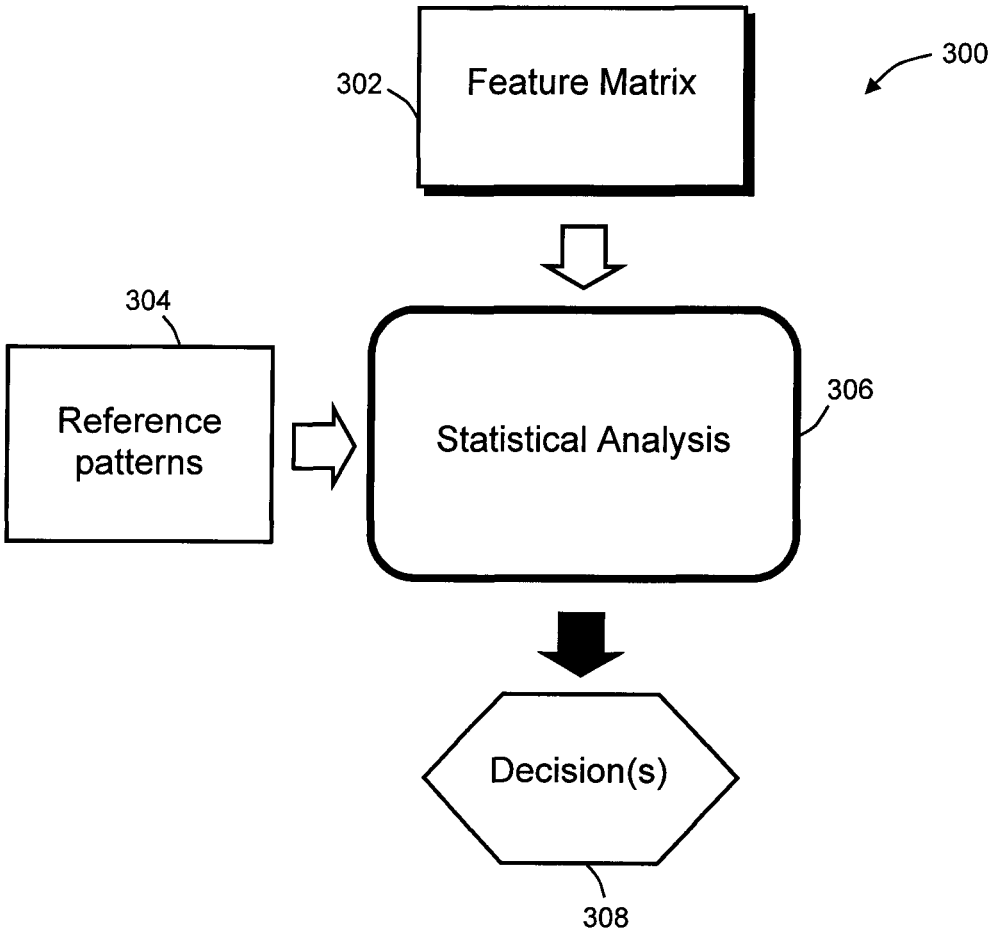
Figure 4:
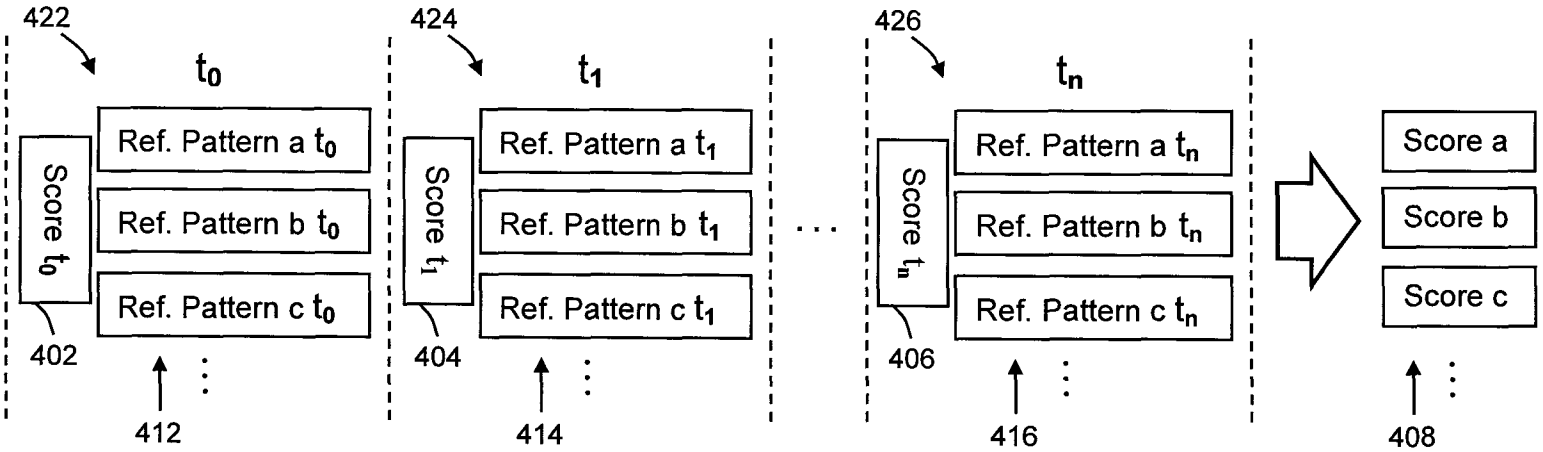
Figure 5:
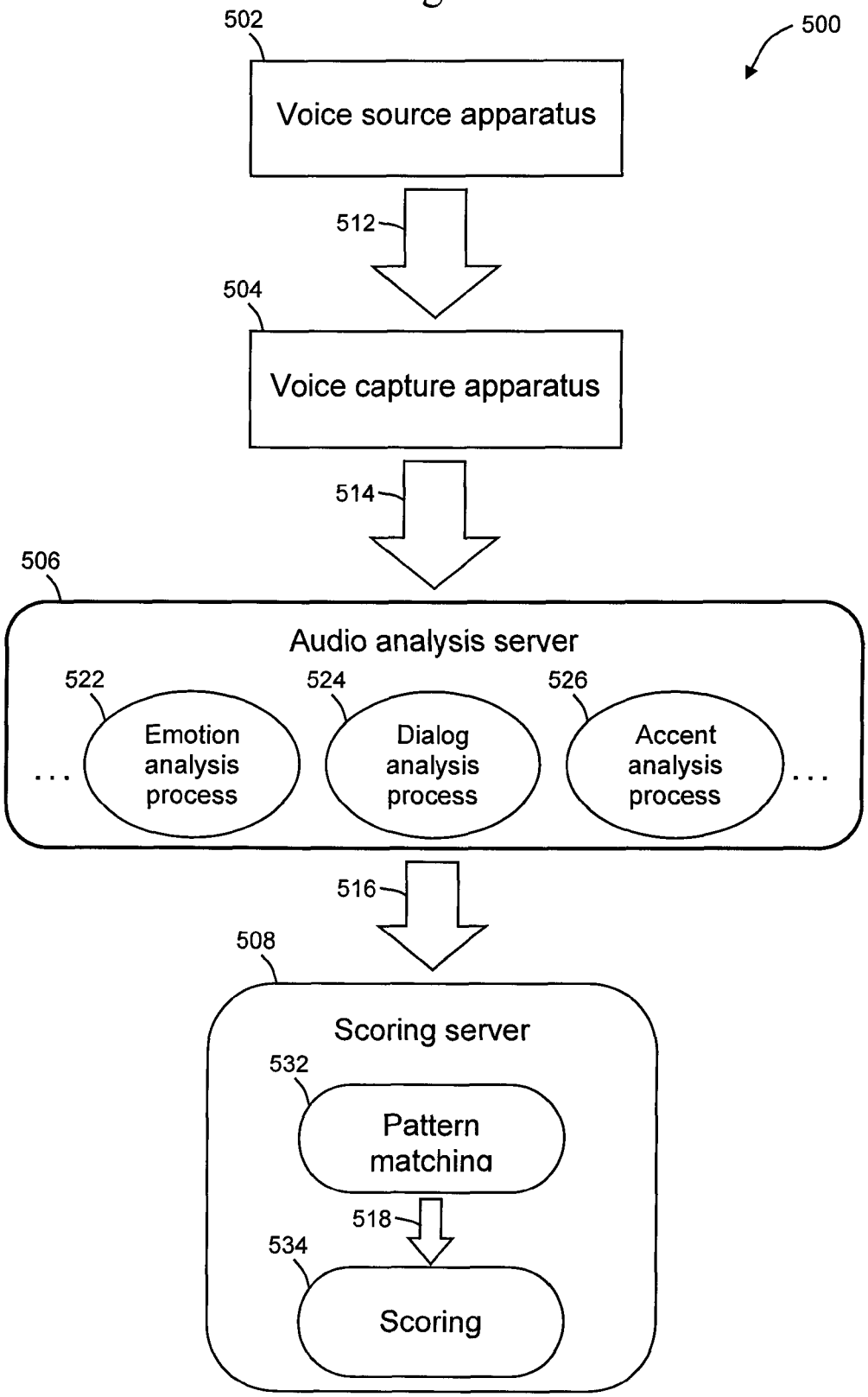
Figure 6:
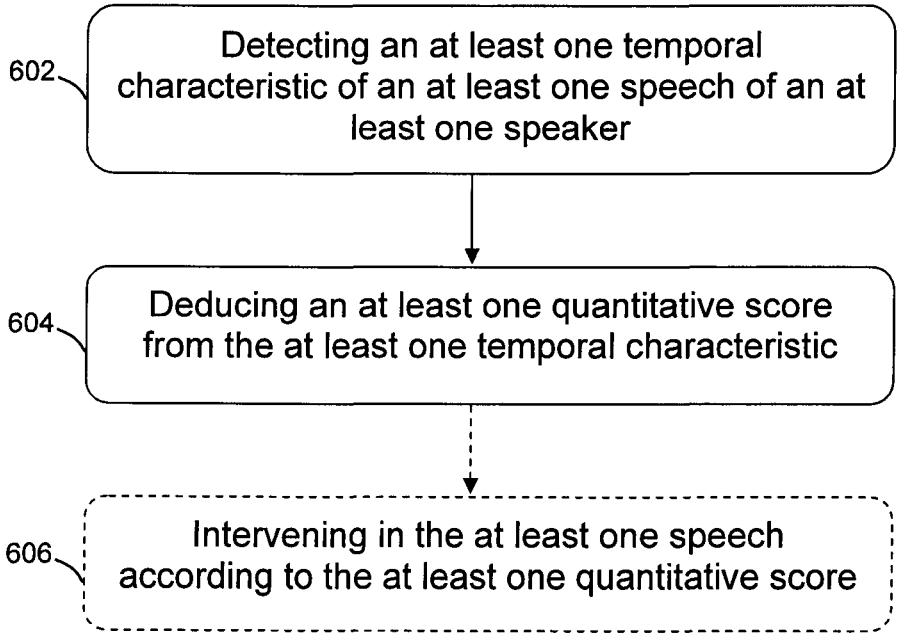
Figure 7A:
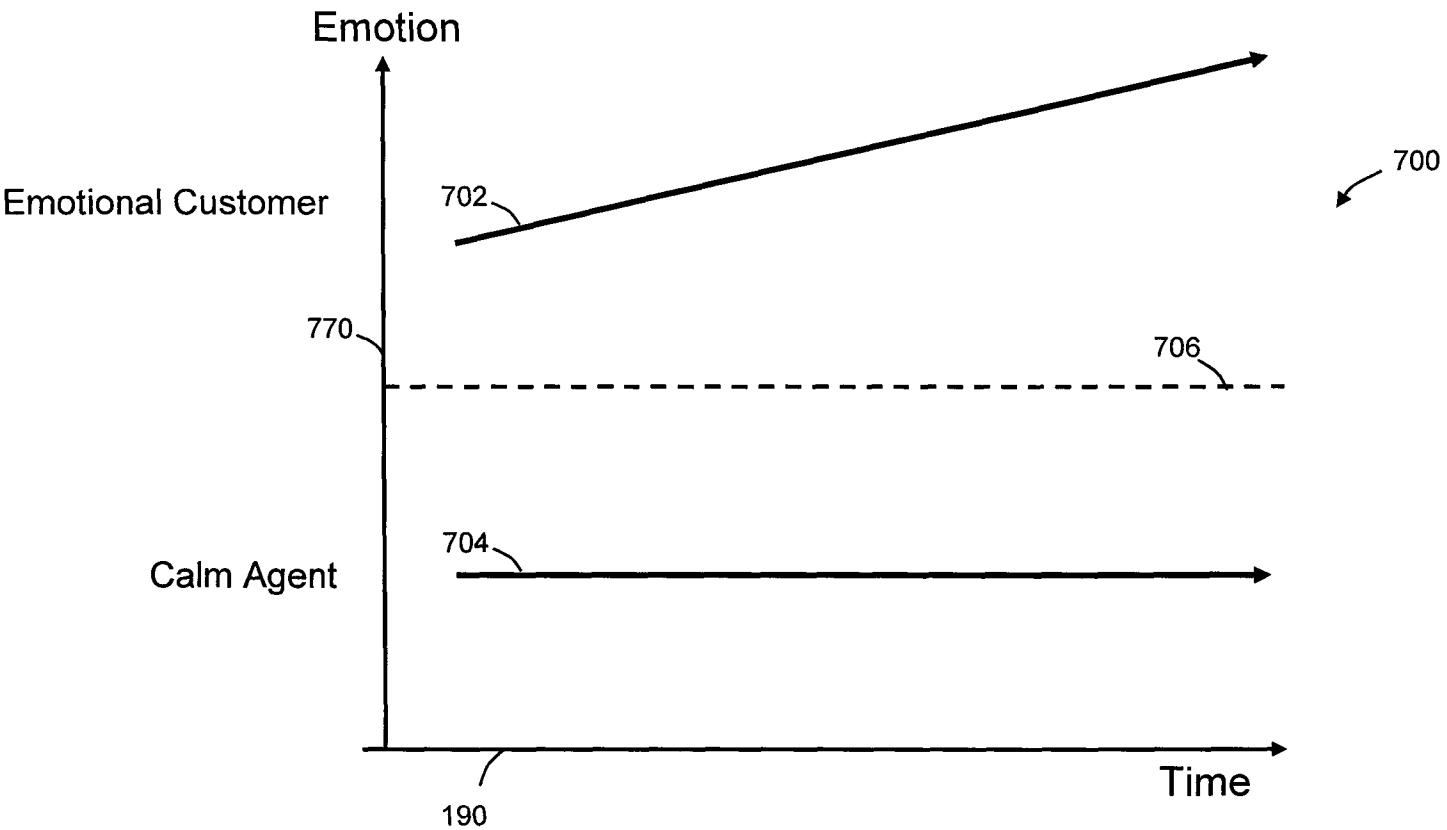
Figure 7B:
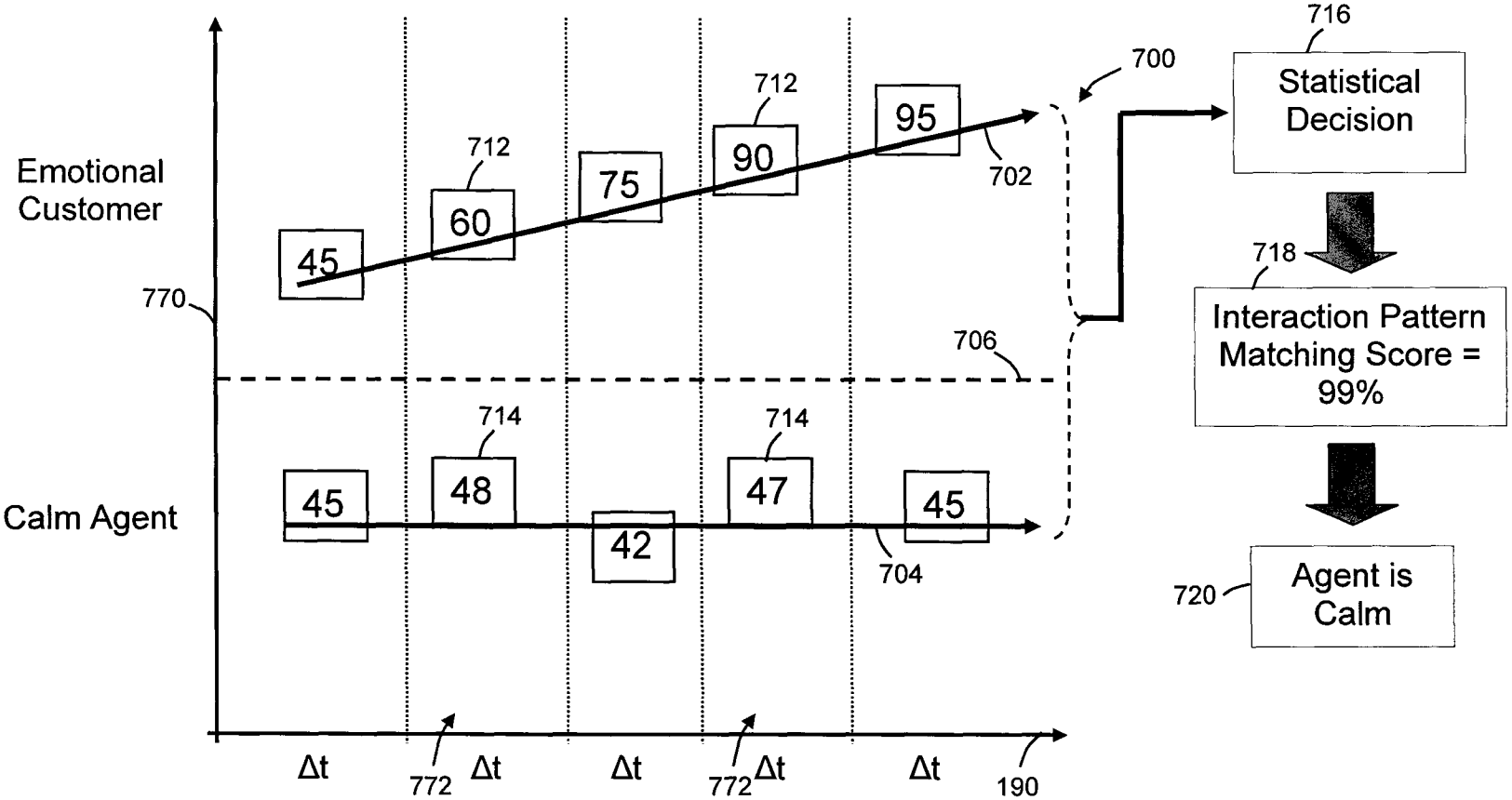
Figure 8A:
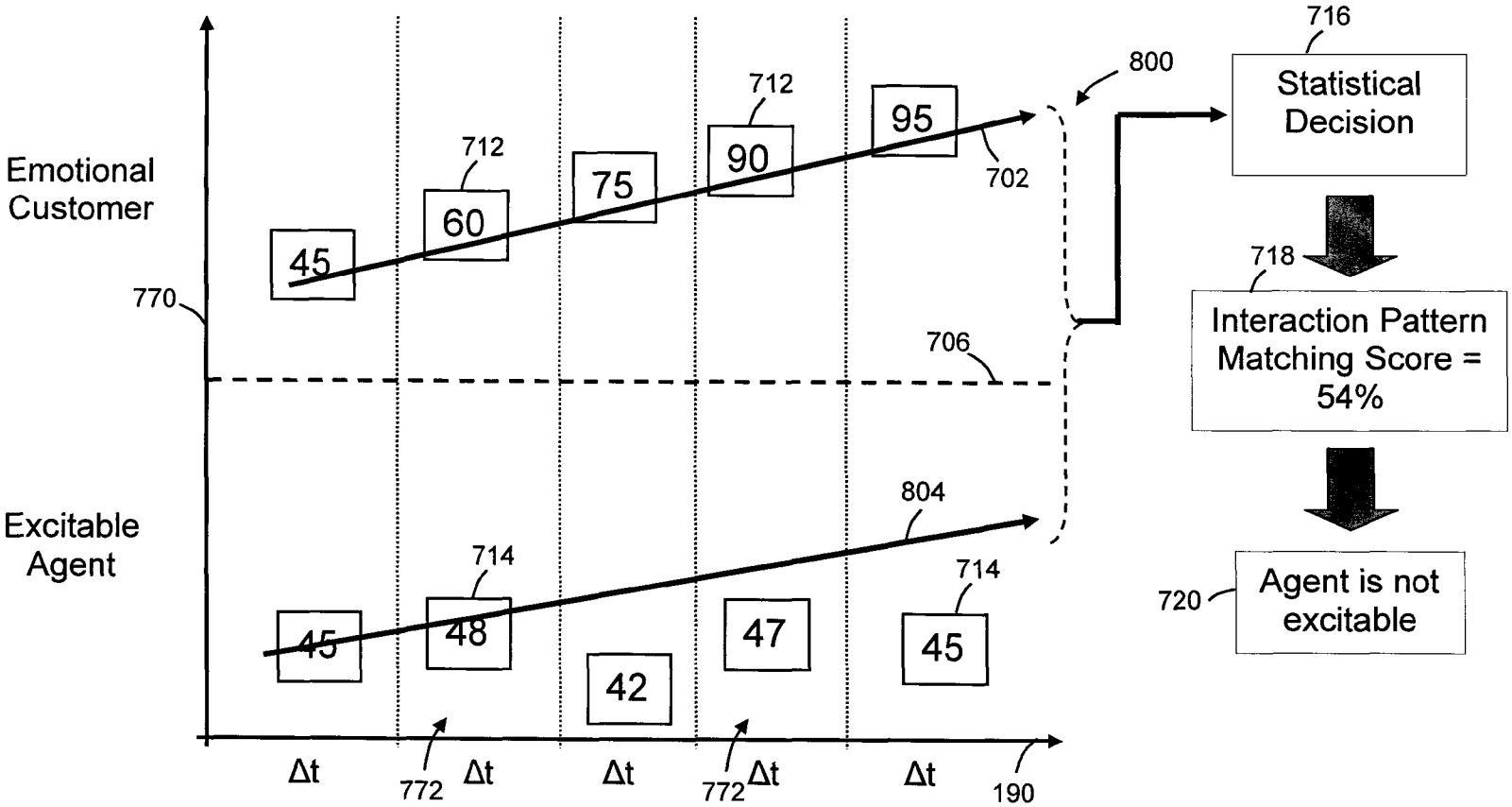
Figure 8B:
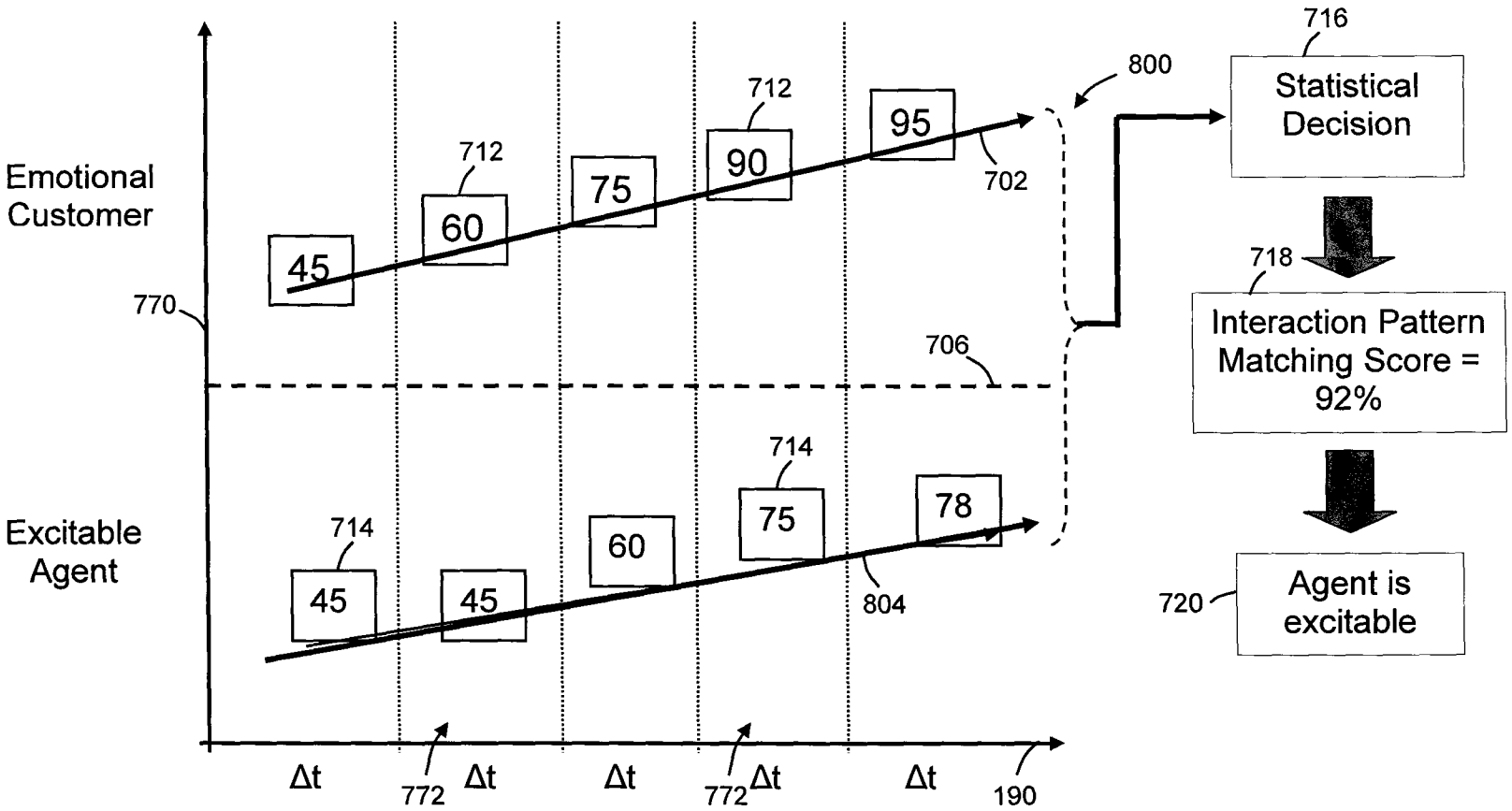

FIG. 1A schematically illustrates a temporal pattern of interaction between two participants without overlapping talk, according to exemplary embodiments of the disclosed subject matter;

FIG. 1B schematically illustrates a temporal pattern of interaction between two participants with overlapping talk, according to exemplary embodiments of the disclosed subject matter;

FIG. 1C schematically illustrates a temporal pattern of interaction between two participants with overlapping talk and increasing intonation activity, according to exemplary embodiments of the disclosed subject matter;

FIG. 2 schematically illustrates a scoring system, according to exemplary embodiments of the disclosed subject matter;

FIG. 3 schematically illustrates a decision system based on a feature matrix, according to exemplary embodiments of the disclosed subject matter;

FIG. 4 schematically illustrates derivation of a score from a plurality of scores, according to exemplary embodiments of the disclosed subject matter;

FIG. 5 schematically illustrates an architecture of a scoring system, according to exemplary embodiments of the disclosed subject matter;

FIG. 6 schematically outlines operations for obtaining a score of a speech, according to exemplary embodiments of the disclosed subject matter;

FIG. 7A schematically illustrates a reference pattern of emotions of an emotional customer and a calm agent, according to exemplary embodiments of the disclosed subject matter;

FIG. 7B schematically illustrates matching timed-scores of emotions with a reference pattern of an emotional customer and a calm agent, according to exemplary embodiments of the disclosed subject matter;

FIG. 8A schematically illustrates a weak matching of timed-scores of emotions with a reference pattern of an emotional customer and an excitable agent, according to exemplary embodiments of the disclosed subject matter; and FIG. 8B schematically illustrates a strong matching of timed-scores of emotions with a reference pattern of an emotional customer and an excitable agent, according to exemplary embodiments of the disclosed subject matter.

DETAILED DESCRIPTION

One technical problem dealt with by the disclosed subject matter is obtaining a quantitative score or rating of behavior of speakers in a verbal interaction based on non-verbal expressions of the verbal interaction, and more specifically based on temporal attributes or characteristics of the verbal interaction.

Another technical problem dealt with by the disclosed subject matter is determining the state or behavior of a speaker, or a disposition or behavior of verbally interacting participants towards each other. For example, in a service call between a customer and a service agent, determining amicable dialog or an annoyance of the customer or an exhaustion of the agent.

Yet another technical problem dealt with by the disclosed subject matter is determining whether a verbal interaction between participants requires intervention by an authority, and the nature of the intervention. For example, whether a supervisor should intervene in a service call between an irritated customer and a service agent.

One technical solution is a voice acquisition apparatus coupled to one or more processors operating according to a program that detects and analyzes temporal variations in the speech of speakers, and correlates the temporal variations with predetermined reference patterns of behavior of speakers. Based on the correlation a quantitative score or rating of behavior of the speakers is derived.

Another technical solution is a voice acquisition apparatus coupled to one or more processors operating according to a program that analyzes temporal variations in the speech of a speaker and/or temporal variations in the speech of one speaker respective to another speaker, and according to the temporal variations provides a score indicative of the mood of the speaker and/or attitude of the speakers to each other.

Yet another technical solution is a voice acquisition apparatus coupled to one or more processors operating according to a program that analyzes temporal variations in the speech of speakers in a verbal interaction, and according to the temporal variations provides an indication whether an intervention is required or desirable and the nature of the intervention.

A potential technical effect of the disclosed subject matter is reducing communications time and costs due to increased contentment of a participant such as a customer and reduction of possible disagreements.

Another potential effect is improved management of personnel, thereby, for example, reducing fatigue or stress and increasing the efficiency of communication of agents with customers.

Yet another potential effect is increasing revenue by identifying opportunities for sale of products or services and improving service reputation.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

A speech of a person is generally non-monotonous and varies with time, such as due to emotion or the importance of the issues involved.

When two or more persons are interacting in a conversation, the speech of one person may be affected by another person so that the speech of one person varies in time due to the speech of another person.

The temporal variations or temporal characteristics of a speech of one person or two or more persons in a conversation may correlate and/or correspond with and/or conform to and/or match and/or fit a pattern and/or a function and/or other constructs or measures such as a model or a statistic, to a certain extent at least.

For brevity and clarity and without limiting, the pattern and/or function and/or other constructs or measures are collectively denoted herein as a reference pattern.

For brevity and clarity and without limiting, identifying to an at least a certain extent a correspondence or a similarity of a temporal characteristic of a speech relative to a reference pattern, and/or matching or fitting to an at least a certain extent a temporal characteristic of a speech with a reference pattern, are collectively denoted herein as matching and/or correlating.

The matching result is denoted herein also as a correlation, where the correlation between a temporal characteristic and a reference pattern may be within a spread stretching from nil to a unity.

In some embodiments, a plurality of reference patterns may be established according to various temporal characteristics of and/or related to a verbal interaction.

For example, each reference pattern depicts or represents or manifests a certain behavioral aspect as reflected in temporal characteristics of a verbal interaction.

The reference patterns may be established according to past verbal interactions that were analyzed to extract or identify behavioral features as manifested in temporal variations or characteristics. Optionally, the reference patterns may be established according to calculations that predict or anticipate, such as by behavioral models, temporal characteristics of a verbal interaction. Optionally or additionally, the reference patterns may be established according to both of historical data and calculations. Optionally, in some embodiments, the reference patterns are updated and/or refined based on recent or current verbal interactions.

In some embodiments, the reference patterns are classified to classes according to the mood or state of a speaker, or according to the attitude of one speaker to another, or according to the atmosphere of the verbal interaction, or according to a combination thereof. Optionally, other considerations may be taken into account, for example, the mutual accents of the speakers.

For example, one reference pattern may be classified as 'polite' since it depicts no or little overlapping speech relative to speech periods. And, for example, another reference pattern may be also classified as 'polite' since it depicts overlapping speech yet without substantial increased pitch of any of the speakers. Similarly, for example, a reference pattern may be classified as 'emotional' where there are frequent overlapping speeches with progressively increased pitch of at least one speaker, and when there is progressively increase of word rate a reference pattern may be classified as 'impatient'. Likewise, the reference patterns maybe classified in various manners.

In some embodiments, the classifications of the reference patterns partially overlap, providing refined characterizations of a verbal interaction.

In some embodiments, the classifications of the reference patterns are modified such as according to accumulated performance and/or additional data. Optionally, the classifications of the reference patterns are adjusted, at least provisionally, according to the time or date. For example, at ends of weeks or late afternoons the prominence of a classification may be reduced, such as allowing some increase of word rate without classifying a reference pattern as 'impatient'.

Having a collection of reference patterns, in some embodiments, an instance of a verbal interaction may be matched or correlated with the various reference patterns. Extents or degrees of the similarities between the temporal characteristics of the instance of the verbal interaction with respect to the reference patterns are evaluated.

Thus, for a given reference pattern, a score of an instance of a verbal interaction regarding a given reference pattern is provided, the score indicating the degree of similarity or extent of relevancy of the instance of the verbal interaction with respect to the given reference pattern. In other words, a score relates to a correlation between a temporal characteristic and one or more a reference patterns, where the relation may be by scaling or other transformations, so that the score is respective to a the correlation.

Thus, for example, assuming scores in a 100% percentage range, the scores of a verbal interaction may be 35% 'emotional', 60% 'impatient' and 15% 'polite'. In some embodiments, the scores may be grouped and optionally combined, thereby providing particular indications, such as, for example, 'erratic'.

Optionally or additionally, the scores are evaluated to reflect grades, for example, as 'High', 'Medium' and 'Low'. Thus, for example, the scores of a verbal interaction may be freely phrased as 'emotional'/'Medium', impatient'/'High' and 'polite'/'Low' and a combined score may be, for example, 'aggressive'/'High'.

In some embodiments, the scores vary along the time of a verbal interaction. As a freely phrased example, a verbal interaction is given a high 'polite' score and low 'impatient' and 'emotional' scores, but as the interaction progresses and heats up the 'polite' score is reduced and 'impatient' score becomes high while 'emotional' score becomes medium, whereas towards the end of the verbal interaction the 'impatient' and 'emotional' scores both become high where the 'polite' score is nullified.

In some embodiments, a plurality of scores, such as pertaining to different periods or times of a verbal interaction is correlated with a plurality of reference patterns related to different periods or times to yield a score for the verbal interaction.

In some embodiments, temporal characteristics of a speech are derived from time intervals of a verbal interaction. Optionally, the temporal characteristics are derived from sequential time intervals, optionally as consecutive time intervals. Optionally or additionally, the temporal characteristics are derived from non-sequential time intervals, such as determined according to certain factors or such as randomly selected intervals.

In some embodiments, the time intervals are based on pre-defined or determined period. Optionally or alternatively, the time intervals are based on temporal features of the verbal interaction such as pauses. Optionally or additionally, the time intervals are based on detection of words or sentences.

FIG. 1A schematically illustrates a temporal pattern 110 of interaction along a time axis 190 between two participants without overlapping talk, according to exemplary embodiments of the disclosed subject matter.

While a first participant or a first speaker is talking then a second participant or a second speaker is silent or listening, and vice versa.

As illustrated in temporal pattern 110, the talk of the first speaker, denoted as a first speaker 102 or as S1, does not overlap the talk of a second speaker, denoted as a second speaker 104 or as S2, as demonstrated by vertical lines 106.

Considered solely, temporal pattern 110 represents, without limiting, a 'polite' class of interaction as there is no interference between the speakers.

FIG. 1B schematically illustrates a temporal pattern 120 of interaction along a time axis 190 between two participants with overlapping talk, according to exemplary embodiments of the disclosed subject matter.

While a first participant or a first speaker is talking then a second participant or a second speaker interferes, and vice versa.

As illustrated in temporal pattern 120, the talk of first speaker 102 overlaps at least partially the talk of second speaker 104 as demonstrated by vertical lines 106 and interference period 108.

Considered solely, temporal pattern 120 represents, without limiting, a 'polite' class of interaction in case the overlap or intervention is small relative to the overall talk times of the speaker, and may represent an 'impatient' or an 'emotional' class in case the intervention is above a certain degree relative to the overall talk periods of the speakers.

FIG. 1C schematically illustrates a temporal pattern 130 of interaction between two participants with overlapping talk and increasing volume, according to exemplary embodiments of the disclosed subject matter.

A horizontal axis 190 represents time of the interaction while a vertical axis 180 represents audible volume or volume of the talk of the speakers. Vertical axis 180 denotes units such as decibels or any other units including arbitrary units.

While a first participant or a first speaker is talking then a second participant or a second speaker interferes, and vice versa, where the volume of the participants is increasing.

As illustrated in temporal pattern 130, the talk of first speaker 102 overlaps at least partially the talk of second speaker 104, and, additionally, the volume of first speaker 102 increases more than the increase in volume of second speaker 104.

Considered solely, temporal pattern 130 represents, without limiting, an 'impertinent' class of interaction, at least as first speaker 102 is concerned, and/or temporal pattern 130 represents, without limiting, an 'emotional' class. Optionally, the classification depends on the amount and/or rate of increase of volume and/or the duration of the increase of volume, at least of one participant.

Thus, considering temporal pattern 120 and temporal pattern 130, a verbal interaction or a corresponding reference pattern may be denoted or classified as 'polite' in case the amount of intervention and the increase in volume of the speakers is low, for example, less the 30%, respectively. Likewise, a reference pattern may be denoted or classified as 'emotional' or 'aggressive' in case the overlap and/or intervention and volume increase, at least of one speaker is high, for example, above the 50%, respectively. Similarly, a reference pattern may be classified as 'emotional' in case the intervention periods increase in time such as from less then 20% to over 70% with respect to the overall time of the verbal interaction.

Thus, for example, an instance of a verbal interaction may be matched with a reference pattern, and in case the increase in volume of each participant is less than 20% and the interference is less than 30% then the instance of the verbal interaction may be scored as 25% 'emotional' and 75% 'polite' or as overall 'polite' or as 'polite'/'Medium'.

Similarly, other considerations may be taken into account, optionally in addition the intervention and/or volume variations to considerations described above.

In some embodiments, temporal characteristic considered for a verbal interactions comprise, without precluding other temporal characteristics of other considerations, one or more or any combination of the following:

interference period, either absolute and/or relative to the verbal interaction time,
variation of the volume of one or more speakers,
frequency of increase or decrease of a volume of a speaker,
silence periods,
talking distribution of the speakers,
short filler periods of speech
periods of speech,
syllables per second,
accent of speech or one or more speakers,
words per minute,
monotonic pitch patterns,
'mirroring', or reflection, of speaking rate patterns between the speakers.

Optionally, verbal characteristics supplement or augment the classification of a reference pattern, such as linguistic choices of words or phrases, or other variable speaker-based acoustic or other information.

FIG. 2 schematically illustrates a scoring system 200, according to exemplary embodiments of the disclosed subject matter.

Scoring system comprises a plurality of analysis modules that analyze a speech of one or more speakers in a verbal interaction and provide the analysis results to a scoring engine. In the scoring engine the analysis results are matched with one or more reference patterns, thereby yielding at least one score per a reference pattern. It is noted that a score may be low as nil or practically nil, indicting that the verbal interaction is far too different from a reference pattern.

In some embodiments, an emotion analysis module 202 receives a verbal interaction and analyzes temporal characteristics of the speech to detect or deduce emotional behavior of one or more speakers.

In some embodiments, dialog analysis module 204 receives a verbal interaction and analyzes temporal characteristics of the speech to detect or deduce speech dialog and/or speech exchange between the speakers.

In some embodiments, accent analysis module 206 receives a verbal interaction and analyzes acoustic characteristics of the speech to detect or deduce accent of one or more speakers.

Analysis modules such as emotion analysis module 202, dialog analysis module 204 and accent analysis module 206 represent, without limiting, optional other and/or additional analysis modules.

A scoring engine 208 accepts the results from the analysis modules and processes and/or analyzes the results of the analysis modules to match the results with one or more of reference patterns that correspond to the analysis modules and/or other reference patterns that depicts certain characteristics of the verbal interaction. For example, the results of emotion analysis module 202 are matched with one or more reference patterns that correspond or relate to emotional behavior and, optionally, reference pattern or patterns that depicts certain characteristics or emotion or the lack thereof.

In some embodiments, emotion analysis module 202 identifies or evaluates emotion by temporal characteristics such as varying volume of speech, rate of phrases, increasing or decreasing intervention periods or types of pitch contour or profile over time, or other characteristics that convey emotion.

In some embodiments, dialog analysis module 204 identifies or evaluates speech pattern or patterns by temporal characteristics such as silence periods, simultaneous talking periods, talking distribution of participants, short filler periods of speech, long periods of speech, phrases rate, monotonic pitch patterns, amplitude variations, or other variable speaker-based acoustic or other information such as linguistic choices of words or phrases.

In some embodiments, accent analysis module 206 detects characteristics such as frequency range and/or variations and/or distribution using techniques such as Fourier transform or wavelet transform and/or other techniques of the art. Based on the detected characteristics, scoring engine 208 determines the distance or other measure of disparity between the speakers' accents to the native accent of the verbal interaction language, and/or the distance or other measure of disparity between the accents of the speakers. In some embodiments, the determination is based on reference pattern or patterns deduced from actual speeches and/or machine speech tuned for a particular accent.

Based on the matching of the results from the analysis modules with reference patterns and optional further processing, scoring engine 208 yields for one or more of the analysis modules an at least one corresponding score 210 denoting the extent of fitting to the corresponding pattern and/or other reference patterns. For example, scoring engine 208 yields a score denoting the extent of emotion in the speech of one or more speakers in a verbal interaction.

In some embodiments, score 210 denotes a plurality of scores for one or more of the corresponding pattern and/or other reference patterns that depicts certain characteristics of the verbal interaction.

In some embodiments, scores are evaluated for a plurality of time intervals of a verbal interaction, and are matched with pluralities of reference pattern for corresponding time intervals to yield a representative score for the verbal interaction.

In some embodiments, a plurality of scores are combined or analyzed to provide one or more representative scores. For example, the scores for 'emotion' are averaged to provide a representative score for 'emotion' and the scored for 'polite' are averaged to provide a representative score for 'polite'. Optionally or alternatively, a single score is deduced to yield one score depicting temporal behavior of the verbal interaction. For example, in a range of 100, a score below 20 denotes a polite or civilized verbal interaction, a score between 20 and 50 denotes an emotional verbal interaction, a score between 60 and 80 denotes an impatient verbal interaction, and a score above 80 denotes an aggressive verbal interaction.

In some embodiments, based on a temporal characteristic or a combination of temporal characteristics of a verbal interaction, a score or classification of the mood or state of a speaker may be determined or evaluated such as by a scoring.

For example, the empathy of a first speaker towards a counterpart second speaker may be determined if during a verbal interaction the word rate of the first speaker increases absolutely relative to the word rate of the second speaker.

As another example, a fatigue of a speaker may be determined if during a work day the volume of the speech and/or the variability of the pitch of the speech and/or the rate of speech of the speaker decline by a certain extent and/or below a certain threshold.

In some embodiments, the analysis modules analyze the same verbal interaction, wherein, optionally, different analysis modules analyze different parts of the verbal interaction.

It is noted that a score may reflect a behavior of a speaker by himself or herself, and may also reflect the behavior of a speaker with respect or responsive to another speaker participating in the verbal interaction.

Below is described a non-limiting example of deriving scores, and/or an overall score based on scores for certain time intervals of a verbal interaction A matrix referred to also as a feature matrix, denoted as Matrix-1, is constructed as shown below.

$$\begin{matrix} E(te_0) \ldots E(te_n) \\ D(td_0) \ldots D(td_n) \\ A(ta_0) \ldots A(ta_n) \\ P(tp_0) \ldots P(tp_n) \\ \ldots \end{matrix} \qquad \text{Matrix-1}$$

Each row is a vector of a time oriented sequence of scores of a particular kind, the sequence expressed according to a generic format of $X(tx_0) \ldots X(t_n)$, in which $X(tx_0)$ is a score of kind X at a start time $tx_0$ and $X(tx_n)$ is a score X at an end time $t_n$.

In the generic format X represents, respectively, E for emotion, D for dialog, A for accent, and P for phrases rate. In some embodiments, X denotes a score of one or more other kinds and/or one or more additional kinds, illustrated by the ellipsis in the last row of Matrix-1.

The time oriented sequence of scores is obtained for consecutive time intervals of a verbal interaction, for example, as described above and/or according to scoring system 200 of FIG. 2. For example, a time $tx_k$ may represent the start, end or middle of a $k^{th}$ time interval.

In some embodiments, the time span $tx_0 \ldots t_n$ and the time intervals for which the scores are obtained are the same for all the scores' kinds. Optionally or alternatively, the time span $tx_0 \ldots t_n$ and/or the time intervals are different for one or more of the scores' kinds.

In some embodiments, statistical analysis is performed on the feature matrix, the result of which is then used to decide to what extent a particular reference pattern is matched.

FIG. 3 schematically illustrates a decision system 300 based on a feature matrix, according to exemplary embodiments of the disclosed subject matter.

A feature matrix 302 and a plurality of reference patterns 304 are provided to a statistical analysis module 306. Using one or more techniques, statistical analysis module 306 matches the time oriented scores of a verbal interaction in feature matrix 302 to the plurality of reference patterns 304 to obtain a decision as to the classification of the verbal interaction.

In some embodiments, statistical analysis module 306 uses hidden Markov model (HMM). Optionally or additionally, statistical analysis module 306 uses one or more decision tree. Optionally or additionally, other techniques of the art are used such as fuzzy logic or neural networks. Optionally, a combination of techniques is used by statistical analysis module 306.

In some embodiments, a decision is an overall score for a particular kind or classification of a verbal interaction. Optionally or alternatively, a decision is an overall score for the verbal interaction.

Thus, statistical analysis module 306 provides, as an output thereof, at least one of decision 308 as a representative score for the verbal interaction. Optionally or additionally, statistical analysis module 306 provides, as an output thereof, a decision per kind or type of a reference pattern as a representative score of a particular kind or type of interaction, for example, a score for 'polite', a score for 'emotion' and a score for 'agitated', and so forth.

In some embodiments, statistical analysis module 306 provides at least one decision per time interval or time of scores, as for example, described above and illustrated by the $k^{th}$ time interval or time $tx_k$ with respect to Matrix-1. In some embodiments, the at least one decision per time interval or per time of scores is a score, referred to also as timed-score.

In some embodiments, a decision such as decision 308 is not a final stage of scoring or classification of a verbal interaction, but rather, an intermediate stage.

In some embodiments, given such as by statistical analysis module 306 a collection of timed-scores, a final or finer scoring is obtained by comparing the timed-scores with specific types or kinds of reference pattern in order to obtain the best or at least a sufficient match.

FIG. 4 schematically illustrates derivation of a score from a plurality of timed-scores, according to exemplary embodiments of the disclosed subject matter.

For each time $tx_k$, denoted respectively as time 422, time 424 and time 426 for $t_0$, $t_1 \ldots t_n$, a respective timed-score, denoted as score 402, score 404 and score 406, respectively, is matched with sets of reference patterns for the respective times, denoted as set 412, set 414 and set 416, respectively.

The matching of the timed-scores with the reference patterns for the respective times yield for each pattern a score, the scores denoted collectively as overall scores 408.

For example, if a speaker was calm at the beginning of a verbal interaction, yet not at the end thereof, the output of emotion analysis module 202 would change accordingly from low to high over time, which would be reflected in the feature matrix such as Matrix-1 which is used for determining the decisions as described, for example, above.

If a reference pattern is statistically relevant, then the pattern of the results of emotion analysis module 202 is compared to one of the reference patterns such as reference patterns in set 412, set 414 and set 416. If one of the reference patterns, such as representing an 'aggressive speaker' has a low-to-high variation of emotion over time, and the results of emotion analysis module 202 reflect the reference pattern to a sufficiently significant level, the decision or score for the reference pattern would be high. If the pattern of the results of emotion analysis module 202 is not similar to the reference pattern, then the score for the pattern would be low.

Similarly, other time-dependent patterning that is found in the verbal interaction would be statistically analyzed, compared to results of dialog analysis module 204, or results of accent analysis module 206 or other outputs, and provided with a score that reflects the extent that they fit a particular reference pattern.

Likewise, overall scores can be obtained that reflect certain interactive behavior patterns or traits of speakers. For example, a particular speaker may be scored as being a repeatedly aggressive type, or another speaker may be scored as being a 'good listener'.

FIG. 5 schematically illustrates an architecture of a scoring system 500, according to exemplary embodiments of the disclosed subject matter.

Scoring system 500 comprises parts or components as described below as a non-limiting example.

A voice source 502, comprising apparatus and/or system of apparatus, such as a telephone apparatus, internet calls computer, videoconferencing system, or other sources such as play-back of a recording machine or a microphone.

The voice of voice source 502, also referred to as a raw voice, is provided via a path 512 to a voice capture apparatus 504 that captures the voice. Optionally, voice capture apparatus 504 performs some processing on the raw voice, such as filtering for noise reduction or echo cancellation or other clean-up or preprocessing operations such as reducing data rate and/or bandwidth to reduce the data size. In some embodiments, the clean-up operations, or part thereof, are performed by another device coupled to voice capture apparatus 504. Capturing of the raw voice comprises analog-to-digital conversion (ADC) in case the raw voice comprises an analog signal.

The output of voice capture apparatus 504, also referred to as a clean voice, is provided by a path 514 to an audio analysis server 506.

Audio analysis server 506 optionally performs some initial and/or auxiliary processing on the clean voice. For example, parsing the clean voice for pauses, phrases or syllables. Audio analysis server 506 comprises processes or modules for analyzing temporal characteristics and/or variations of the clean voice. For example, emotion analysis process 522, dialog analysis process 524 and accent analysis process 526, such as or similar to emotion analysis module 202, dialog analysis module 204 and accent analysis module 206 of FIG. 2. It is noted that emotion analysis, dialog analysis and accent analysis may be supplemented or replaced by other processes or modules as indicated by the ellipsis, such as, for example, a linguistic analysis.

Output of Audio analysis server 506, structured according to temporal features of the clean voice, is provided by a path 516 to a scoring server 508 that corresponds to or equals, at least partially, scoring engine 208 of FIG. 2.

Scoring server 508 comprises processes or modules for achieving scoring with respect to the temporal characteristics of the raw voice or clean voice. For example, a pattern matching process 532 that provides, by path 518, time oriented scored to a scoring process 534 that yield overall scores. Pattern matching process 532 performs operations such described, at least partially, with respect to matrix-1 and statistical analysis module 306, and scoring process 534 performs operations such described, at least partially, with respect to FIG. 4.

Voice capture apparatus 504, and audio analysis server 506 and scoring server 508 are computerized devices comprising at least one processor and operate according to a program stored on a device and/or comprising electronic circuitry such as ASIC to operate the same.

The computerized devices may be integrated therebetween, at least partially, or, alternatively, the computerized units may be distributed, at least partially, among different units. For example, audio analysis server 506 and scoring server 508 may be comprised in the same unit, or for example, emotion analysis process 522, dialog analysis process 524 and accent analysis process 526 each operates on a different unit.

Path 512 passes the raw voice as signal either in analog or digital form and path 514 passes the clean voice in a digital form.

Path 514, path 516 and path 518 are either physical link such as wire or wireless connections, or are conceptual links where the data is shared in or transferred in a memory as operated by a program executable by a processor.

In some embodiments, processes such as described above are not necessarily separate entities of execution threads or tasks, but rather, the processes operate as a single execution threads or task.

In some embodiments, processes such as described above operate sequentially to each other and/or in parallel with each other. For example, emotion analysis process 522, dialog analysis process 524 and accent analysis process 526 may operate in parallel as different execution threads and/or on different processors.

In some embodiments, scoring system 500 operates in real-time. For example, as a verbal interaction is detected at voice source 502, voice capture apparatus 504 starts to capture the raw voice and audio analysis server 506 scoring server 508 are initiated.

In some embodiments, scoring system 500 comprises a memory buffer, optionally as a part of voice capture apparatus 504. For example, as a verbal interaction is detected at voice source 502, the raw voice is stored in the memory buffer, optionally packed and/or with reduced data rate. Consequently, audio analysis server 506 scoring server 508 are initiated where audio analysis server 506 receives buffered data as the verbal interaction carries on.

In some embodiments, scoring system 500 operates off-line, where, optionally, raw voice or clean voice are stored and are processed in later on. For example, the voice is used to construct reference patterns or for studying.

FIG. 6 schematically outlines operations for obtaining a score of a speech, according to exemplary embodiments of the disclosed subject matter.

At 602 an at least one temporal characteristic of an at least one speech of an at least one speaker is detected. In some embodiments, the speech is of one speaker alone or in a verbal interaction such as a conversation, whereas, in some embodiments, the speech is of two or more speakers in a verbal interaction such as a conversation.

The detection comprises identifying or analyzing for temporal characteristics, such as but not limited to:

- interference periods between the speech of two or more speakers, either absolute and/or relative to the verbal interaction time,
- variations and/or frequency of variations of the audible volume of one or more speakers,
- distribution of talking and/or distribution of silence periods of the speakers during a verbal interaction,
- phrases rate, such as syllables per second and/or words or sentences per minute,
- accent of the speech or one or more speakers,
- similarity or reflection of speaking rate patterns between the speakers.

Optionally, verbal characteristics are also included, such as linguistic choices of words or phrases, or other variable speaker-based acoustic or other information.

At 604 an at least one quantitative score from the at least one temporal characteristic is deduced or derived.

In some embodiments, the deduction or derivation comprises correlating the at least one temporal characteristic with one or more reference patterns where the reference patterns represents reference temporal and/or other characteristics of a speech.

In some embodiments, a plurality of scores is correlated with a plurality of reference patterns to obtain one or more representative scores. For example, a plurality of scores pertaining to different periods or times of a verbal interaction is correlated with a plurality of reference patterns related to different periods or times to yield one or more scores representative of the verbal interaction.

In some embodiments, the one or more reference patterns represent behavior of a speaker or behavior or a plurality of speakers in a verbal interaction and the at least one quantitative score indicates an at least one extent of an at least one behavioral aspect of the at least one speaker.

In some embodiments, the speech is captured from a device such as a microphone or other device such as a telephone or voice-over-IP (VoIP) system, and the detection of temporal characteristics and deduction or derivation of quantitative scores from the temporal characteristics is carried out by a computerized apparatus comprising at least one processor operating according to a program stored or on comprised in a medium or circuitry.

Optionally, at 606, according to the at least one quantitative score the speech is intervened in. For example, if a verbal interaction such as a conversation is determined by one or more scores to be improper such as 'agitated' or 'emotional', another person having an authority over at least one of the speakers may intervene in the conversation. The intervention, in some embodiments, may comprises replacing a speaker of the plurality of speakers, participating in the verbal interaction by an additional speaker, halting the verbal interaction, or any combination thereof. Optionally, the intervention comprises an apparatus responsive to the one or more scores.

In some cases and/or embodiments, an intervention in a verbal interaction is initiated according to and/or responsive to a score or scores of a speech of a speaker or speakers in the verbal interaction In some embodiments, the intervention is carried out by an additional person, such as a person having authority over at least one of the speaker, for example, a supervisor or a manager. Optionally or additionally, the intervention is carried out automatically by an apparatus that responds to the kind and/or levels of a score or scores. For example, if a score indicates that a person becomes emotional, a display visible to the person shows a message or other indication to calm down. As another example, a recording or machine voice may intervene in the verbal indication audibly notifying the speaker so relax.

In some embodiments, an intervention comprises a moderation of a verbal interaction. For example, participating in the verbal interaction by commenting or directives. Optionally or additionally, an intervention comprises one of replacing a speaker or interrupting the verbal interaction or halting the verbal interaction or any combination thereof.

In some embodiments, the scores values are presented or indicated such as by a display of messages or other methods such as visual signs or audible messages. Optionally or additionally, the scores values and/or indications thereof may be provided to another location, optionally a remote location. For example, the scores values are sent to a manager or logged to in a database.

The scoring of the verbal interaction may be further used in business or other cases, some of which are describe below.

In the following description for some non-limiting exemplary cases, the speakers in the verbal interaction are also referred to, without limiting, as a customer and an agent.

A customer starts to shout at an agent on the phone after initial calmness at the beginning of the call. The agent's supervisor may note that the customer's emotion score level is high, and may consider taking over the call or transferring the call to another agent.

A call comes into the customer service department from a customer that is indicated by past experience and/or scores as a dissatisfied customer. The call can be assigned to an agent that has a speech behavior pattern that indicates that the agent is particularly composed when confronted with an emotional customer and/or that the agent is capable of lowering negative emotion levels that occurred at a beginning of the call.

An agent starts to get agitated with a customer on the phone. The supervisor note that the agent's excitement score level is high and can consider switching to another agent who has a better score in the relevant behavior patterns.

A supervisor studies the speech scores of his or her agents in the last week. The supervisor sees that one of the agents received a high score for negative emotion. The supervisor checks down each week day and notices the agent's emotion score rises near the end of evening shifts. The supervisor can consider giving the agent more morning or afternoon shifts and less evening shifts.

A call comes into the customer sales department from a high profile customer. The call can be assigned to an agent that correlates to a behavior pattern that indicates that the agent is capable of maintaining a positive level of emotion throughout the call, which may yield a potential for further sales.

The description below, with corresponding drawings, provides some examples of scoring with respect to reference patterns. Without limiting, the description illustrates how an agent behavior is determined in view of the behavior of a customer. Based on the determined behavior of the agent, a supervisor may decide if and how to intervene in a conversation between the agent and the customer, for example, replacing the agent with an agent having a more appropriate behavior for the customer.

FIG. 7A schematically illustrates a reference pattern 700 of emotions of an emotional customer and a calm agent, according to exemplary embodiments of the disclosed subject matter.

Axis 770 depicts emotions versus a time axis 190. In reference pattern 700 an emotion 702 of the customer increases with time while an emotion 704 of the agent remains constant. For clarity, separating line 706 separates reference pattern 700 into two regions, one for the customer and one for the agent.

It emphasized that reference pattern 700 illustrates a combination of a calm agent as opposed to an emotional customer, representing a composed behavior of the agent when confronted with an emotional customer. Contrarily, for example, a pattern of a calm agent and a calm customer does not necessarily represent a calm agent as the agent is not challenged by the customer.

FIG. 7B schematically illustrates matching timed-scores of emotions with a reference pattern of an emotional customer and a calm agent, according to exemplary embodiments of the disclosed subject matter.

For a plurality of time interval 772, denoted also as $\Delta t$, a plurality of score 712 of customer emotion and a plurality of score 714 of agent emotion is obtained, as described, for example, for score 402, score 404 and score 406 for time 422, time 424 and time 426, correspondingly, with respect to FIG. 4. It is noted that $\Delta t$ is not necessarily identical.

Based on statistical analysis a decision 716, for example, such as emotion analysis process 522 of FIG. 5, the plurality of score 712 of customer emotion and the plurality of score 714 of agent emotion a matching score 718 is obtained, for example, such as by pattern matching process 532. The illustration of FIG. 7B reveals a close matching of the scores with the pattern, yielding a matching score of 99%, for example, such a by scoring process 534. Thus, the designation 720 of the agent is a calm agent, even when confronted with an emotional customer.

It is noted that the agent may be designated as calm when the matching score is above a certain threshold, for example, above 85%. Optionally or additionally, the threshold may be determined responsive to the reference pattern of the customer, for example, if the pattern denotes a very emotional customer, such as that slope of emotion is greater than of emotion 702 of reference pattern 700 than the threshold may be higher, such as 70%.

FIG. 8A schematically illustrates a weak matching of timed-scores of emotions with a reference pattern 800 of an emotional customer and an excitable agent, according to exemplary embodiments of the disclosed subject matter. Similarly to FIGS. 7A and 7B, emotion 702 of the customer increases with time while an emotion 804 of the agent also increases with time, not necessarily as emotion 702 of the customer.

In the same manner as FIG. 7B, the illustration of FIG. 8A reveals a close matching of the scores of the customer with the respective part of the pattern, namely emotion 702, and a weak or partial matching of the scores of the agent with the respective part of the pattern, namely, emotion 804, yielding a matching score of 54%. Thus, the designation 720 of the agent is as a not excitable, even when confronted with an emotional customer.

FIG. 8B schematically illustrates a strong matching of timed-scores of emotions with a reference pattern 800 of an emotional customer and an excitable agent, according to exemplary embodiments of the disclosed subject matter. Similarly to FIG. 8A, emotion 702 of the customer increases with time and an emotion 804 of the agent also increases with time.

In the same manner as FIG. 8A, the illustration of FIG. 8B reveals a close matching of the scores of the customer with the respective part of the pattern, namely emotion 702, as well as a strong or close matching of the scores of the agent with the respective part of the pattern, namely, emotion 804, yielding a matching score of 92%. Thus, the designation 720 of the agent is excitable, at least when confronted with an emotional customer.

A call comes into the technical department from a customer that has called several times that day. The call can be assigned to an agent that received a high accent score, so that the agent will sound confident and reassuring to the customer.

A high profile customer calls the contact center. After resolving his/her problem, the agent/supervisor recognizes an opportunity for a sale. The call is transferred to an agent that was scored with a high percentage of agent's talking periods, which indicates better sales capabilities.

An agent starts to get agitated with a customer on the phone. The supervisor is notified that the agent's excitement score is high and can consider switching to another agent with a high score of customer talking periods, which indicates that the agent is a "good listener".

A first-time calling customer contacts a call center. The call is routed to an agent with a high score of short overtalk fillers, indicating a higher level of initial friendliness towards the customer.

An agent's talking quality is monitored by scores to improve his/her 'empathy' with customers by identifying 'mirroring' speaking rate patterns, such as altering speaking rate depending on the type of rates demonstrated by the caller.

An agent begins to show increasing scores of fatigue, such as limited pitch variation, long periods of silence and/or significantly slower or low-amplitude speech patterns. After a 'fatigue' score threshold is reached, the manager may notify the situation and may choose to alert the agent, replace the agent or allow the agent to take a short break. Such instances can be monitored over time of day to see when the agent becomes the most fatigued, and allow the agent to work during hours that are less prone for fatiguing the agent.

The quality management department can try to improve agents with a high score of silence periods or bursts of emotion.

In some cases the social behavior scoring may point to specific behavior issues specific to an agent. Coaching programs can benefit form the social behavior scoring to pinpoint the areas in which the agent can improve.

Social behavior scoring for agents and customers may be used to determine which the 'next best action' is. For example, angry customers can be transferred to an agent who has scored for specialized techniques aimed at calming down the customer and making the call more empathetic.

Customers may be scored for specific interaction behaviors where the scores may be used for effective handling.

There is thus provided according to the present disclosure a method for speech analysis, comprising detecting an at least one temporal characteristic of an at least one speech of an at least one speaker, and deducing an at least one quantitative score from the at least one temporal characteristic. Optionally, the at least one quantitative score indicates an at least one extent of an at least one behavioral aspect of the at least one speaker.

In some embodiments, the at least one quantitative score comprises a plurality of quantitative scores indicating, correspondingly, a plurality of extents of a plurality of behavioral aspects of the at least one speaker.

In some embodiments, the at least one speech of the at least one speaker comprises, correspondingly, a plurality of speeches of a plurality of speakers.

In some embodiments, the at least one quantitative score indicates an at least one extent of an at least one behavioral aspect of a first speaker with respect to an at least one behavioral aspect of a second speaker.

In some embodiments, the at least one quantitative score comprises a plurality of scores indicating, correspondingly, a plurality of extents of a plurality of behavioral aspects of the first speaker, where, optionally, the at least one quantitative score comprises a plurality of scores indicating, correspondingly, a plurality of extents of a plurality of behavioral aspects of the first speaker with respect to the second speaker.

In some embodiments, the at least one temporal characteristic comprises a plurality of temporal characteristics.

In some embodiments, the at least one temporal characteristic is matched with an at least one reference pattern, thereby providing an at least one quantitative score respective to a correlation between the at least one temporal characteristic and the at least one reference pattern.

In some embodiments, the at least one temporal characteristic comprises a plurality of temporal characteristics that are matched with a plurality of reference patterns, thereby providing a plurality of quantitative scores respective to correlations between the plurality of the temporal characteristics and the plurality of the reference patterns.

In some embodiments, the at least one reference pattern represents behavioral aspect as reflected in temporal characteristics of a verbal interaction, where, optionally, the at least one behavioral aspect comprises an at least one behavioral aspect of a one speaker with respect to another speaker.

In some embodiments, the at least one behavioral aspect comprises at least one of: emotion, talk form, accent or any combination thereof, where, optionally, the at least one quantitative score is used for determining an intervention in a verbal interaction.

There is thus provided according to the present disclosure a method for managing a verbal interaction, comprising detecting an at least one temporal characteristic of an at least one speech of an at least one speaker of a plurality of speakers in a verbal interaction, deducing an at least one quantitative score from the at least one temporal characteristic, and intervening in the verbal interaction according to the at least one quantitative score.

In some embodiments, the intervening is on account of an additional person, where, optionally, the additional person is a supervisor of the at least one speaker.

In some embodiments, the intervening is invoked automatically.

In some embodiments, the intervening is indicated by at least one of: a visual effect, an audible effect, a verbal expression, or any combination thereof.

In some embodiments, the intervening comprises at least one of: replacing a speaker of the plurality of speakers, participating in the verbal interaction by an additional speaker, halting the verbal interaction, or any combination thereof.

There is thus provided according to the present disclosure a method for system for speech analysis, comprising an at least one computerized apparatus operable to analyze temporal characteristics of a captured voice to obtain a quantitative score respective to a correlation between the temporal characteristics and a provided reference pattern.

an apparatus for voice capturing.

In some embodiments, the system further comprises a voice source apparatus.

In some embodiments, the at least one computerized apparatus comprises a plurality of computerized apparatus.

The terms 'processor' or 'computer', or system thereof, are used herein as ordinary context of the art, such as a general purpose processor or micro-processor, RISC processor, or DSP, possibly comprising additional elements such as memory or communication ports. Optionally or additionally, the terms 'processor' or 'computer' or derivatives thereof denote an apparatus that is capable of carrying out a provided or an incorporated program and/or is capable to controlling and/or accessing data storage apparatus and/or other apparatus such as input and output ports. The terms 'processor' or 'computer' denote also a plurality of processors or computers connected, and/or linked and/or otherwise communicating, possibly sharing one or more other resources such as memory.

The terms 'software', 'program', 'software procedure' or 'procedure' or 'software code' or 'code' may be used interchangeably according to the context thereof, and denote one or more instructions or directives or circuitry for performing a sequence of operations that generally represent an algorithm and/or other process or method. The program is stored in or on a medium such as RAM, ROM, or disk, or embedded in a circuitry accessible and executable by an apparatus such as a processor or other circuitry.

The processor and program may constitute the same apparatus, at least partially, such as an array of electronic gates, such as FPGA or ASIC, designed to perform a programmed sequence of operations, optionally comprising or linked with a processor or other circuitry.

In case electrical or electronic equipment is disclosed it is assumed that an appropriate power supply is used for the operation thereof.

The processor and/or program stored in or on a device constitute an article of manufacture.

As used herein, without limiting, a module represents a part of a system such as a part program operating together with other parts on the same unit, or a program component operating on different unit, and a process represents a collection of operations for achieving a certain outcome.

The flowchart and block diagrams illustrate an architecture, a functionality or an operation of possible implementations of systems, methods and computer program products according to various embodiments of the present disclosed subject matter. In this regard, each block in the flowchart or block diagrams may represent a module, segment, or portion of program code, which comprises one or more executable instructions for implementing the specified logical function (s). It should also be noted that, in some alternative implementations, illustrated operations may occur in different order or as concurrent operations instead of sequential operations to achieve the same or equivalent effect.

The corresponding structures, materials, acts, and equivalents of all means or step plus function elements in the claims below are intended to include any structure, material, or act for performing the function in combination with other claimed elements as specifically claimed. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When a range of values is recited, it is merely for convenience or brevity and includes all the possible sub ranges as well as individual numerical values within and about the boundary of that range. Any numeric value, unless otherwise specified, includes also practical close values enabling an embodiment or a method, and integral values do not exclude fractional values. A sub range values and practical close values should be considered as specifically disclosed values.

The terminology used herein is for the purpose of describing particular embodiments only and is not intended to be limiting of the disclosed subject matter. While certain embodiments of the disclosed subject matter have been illustrated and described, it will be clear that the invention is not limited to the embodiments described herein. Numerous modifications, changes, variations, substitutions and equivalents are not precluded.

The invention claimed is:

1. A method for speech analysis, comprising receiving at a computerized apparatus comprising a processor and memory, a signal of a verbal interaction between speakers;

analyzing by the computerized apparatus temporal characteristics of speech of the speakers of the verbal interaction to detect behavioral aspects including: emotional behavior of the speakers, dialog behavior of the speakers and a measure of accent disparity between the accents of the speakers to each other or to a native accent of the verbal interaction language; and deducing quantitative scores for the behavioral aspects of the speakers for a plurality of time intervals;

determining a classification for the verbal interaction based on the quantitative scores.

2. The method for speech analysis according to claim 1, wherein the quantitative scores indicates an extent of behavioral aspects of each speaker.

3. The method for speech analysis according to claim 2, wherein the quantitative scores comprises a plurality of quantitative scores indicating, correspondingly, a plurality of extents of a plurality of behavioral aspects of each speaker.

4. The method for speech analysis according to claim 1, wherein the speech of speakers comprises, correspondingly, a plurality of speeches of a plurality of speakers.

5. The method for speech analysis according to claim 4, wherein the quantitative scores indicates an extent of a behavioral aspect of a first speaker with respect to a behavioral aspect of a second speaker.

6. The method for speech analysis according to claim 5, wherein the quantitative scores comprises a plurality of scores indicating, correspondingly, a plurality of extents of a plurality of behavioral aspects of the first speaker.

7. The method for speech analysis according to claim 5, wherein the quantitative scores comprises a plurality of scores indicating, correspondingly, a plurality of extents of a plurality of behavioral aspects of the first speaker with respect to the second speaker.

8. The method for speech analysis according to claim 1, wherein the temporal characteristics are matched with reference patterns, thereby providing an at least one quantitative score respective to a correlation between the temporal characteristics and the reference patterns.

9. The method for speech analysis according to claim 8, wherein the temporal characteristics are matched with a plurality of reference patterns, thereby providing a plurality of quantitative scores respective to correlations between the plurality of the temporal characteristics and the plurality of the reference patterns.

10. The method for speech analysis according to claim 8, wherein the reference patterns represents behavioral aspect as reflected in temporal characteristics of a verbal interaction.

11. The method for speech analysis according to claim 2, wherein the behavioral aspects comprises behavioral aspects of a one speaker with respect to another speaker.

12. The method for speech analysis according to claim 1, wherein the quantitative scores are used for determining an intervention in the verbal interaction.

13. The method for speech analysis according to claim 12, wherein the intervention is performed by an additional person.

14. The method for speech analysis according to claim 13, wherein the additional person is a supervisor of one of the speakers.

15. The method for speech analysis according to claim 12, wherein the intervention is invoked automatically.

16. The method for speech analysis according to claim 12, wherein the intervention is indicated automatically by a visual effect displayed to one of the speakers.

17. The method for managing a verbal interaction according to claim 12, wherein the intervening comprises at least one of: replacing a speaker, participating in the verbal interaction by an additional speaker, halting the verbal interaction, or any combination thereof.

18. A system for speech analysis, comprising:

a computerized apparatus comprising a processor and memory operable to:

receive a signal of a verbal interaction between speakers;

analyze temporal characteristics of speech of the speakers of the verbal interaction to detect behavioral aspects including: emotional behavior of the speakers, dialog behavior of the speakers and a measure of accent disparity between the accents of the speakers to each other or to a native accent of the verbal interaction language; and deduce quantitative scores for the behavioral aspects of the speakers for a plurality of time intervals;

determine a classification for the verbal interaction based on the quantitative scores.

19. The system for speech analysis according to claim 18, further comprising an apparatus for voice capturing.

20. The system for speech analysis according to claim 18, further comprising a voice source apparatus.

21. The system for speech analysis according to claim 18, wherein the computerized apparatus comprises a plurality of computerized apparatus.

* * * * *